US008903268B2

(12) United States Patent
Ohkura

(10) Patent No.: US 8,903,268 B2
(45) Date of Patent: Dec. 2, 2014

(54) IMAGE FORMING APPARATUS

(71) Applicant: Kyocera Document Solutions Inc., Osaka-shi, Osaka (JP)

(72) Inventor: Yoshimasa Ohkura, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 45 days.

(21) Appl. No.: 13/724,742

(22) Filed: Dec. 21, 2012

(65) Prior Publication Data

US 2013/0164026 A1 Jun. 27, 2013

(30) Foreign Application Priority Data

Dec. 27, 2011 (JP) ..... 2011-285555

(51) Int. Cl.
*G03G 15/00* (2006.01)
*G03G 21/16* (2006.01)

(52) U.S. Cl.
CPC ..... *G03G 21/1647* (2013.01)
USPC ..... 399/110; 347/108; 400/693

(58) Field of Classification Search
USPC ..... 399/107, 110; 347/108; 400/693
See application file for complete search history.

(56) References Cited

U.S. PATENT DOCUMENTS

| | | | | |
|---|---|---|---|---|
| 6,238,115 | B1 * | 5/2001 | Silverbrook et al. | 400/693 |
| 8,109,503 | B2 | 2/2012 | Shirasaki et al. | |
| 2003/0029339 | A1 | 2/2003 | Silverbrook | |
| 2006/0152557 | A1 | 7/2006 | Silverbrook et al. | |

FOREIGN PATENT DOCUMENTS

| | | | |
|---|---|---|---|
| EP | 0 501 789 | B1 | 9/1992 |
| EP | 0 722 839 | A2 | 7/1996 |
| EP | 1 607 230 | A1 | 12/2005 |
| EP | 1 762 393 | A1 | 3/2007 |
| GB | 2 226 794 | A | 7/1990 |
| JP | 06-115725 | A | 4/1994 |
| JP | 07-175285 | A | 7/1995 |
| JP | 09-251222 | A | 9/1997 |
| JP | 2004-269112 | A | 9/2004 |
| JP | 2005-173316 | A | 6/2005 |
| JP | 2005-217327 | A | 8/2005 |

OTHER PUBLICATIONS

Japanese Office Action, Japanese Patent Application No. 2011-285555 mailing date Oct. 22, 2013.
Extended European Search Report, European Patent Application No. 12198894.3, mailed May 28, 2013.

* cited by examiner

*Primary Examiner* — G. M. Hyder
(74) *Attorney, Agent, or Firm* — Arent Fox LLP

(57) ABSTRACT

An image forming apparatus includes vertically connected units, first and second fitting portions, and first and second fitted portions. These fitting portions are provided at a lower portion of an upper unit. These fitted portions are provided at an upper portion of a lower unit downwardly adjacent to the upper unit. The first fitted portion corresponds to the first fitting portion and the second fitted portion corresponds to the second fitting portion. The upper unit is restricted from displacing vertically relative to the lower unit when the first fitting portion engages with the first fitted portion. The second fitting portion engages with the second fitted portion such that the upper unit is restricted from moving horizontally relative to the lower unit, when a user pivots the upper unit downwardly about the first fitting portion while the first fitting portion is engaged with the first fitted portion.

5 Claims, 9 Drawing Sheets

IMAGE FORMING APPARATUS

INCORPORATION BY REFERENCE

This application is based on and claims the benefit of priority from Japanese Patent Application No. 2011-285555, filed on 27 Dec. 2011, the content of which is incorporated herein by reference.

BACKGROUND

This disclosure relates to an image forming apparatus, and in particular relates to an image forming apparatus that includes a plurality of units connected with each other in a vertical direction.

Conventionally, a small image forming apparatus such as a printer can print on sheets of paper of various sizes and on a large number of sheets of paper by selectively connecting units configured for a sheet feed function above or below a unit configured for an image forming function.

A setup is used for connecting the units described above. In this setup, one locating portion (for example, a recessed portion) disposed on a lower surface of an upper unit is engaged with another locating portion (for example, a projecting portion) disposed on an upper surface of a lower unit. A heavy-weight image forming apparatus may also include a connection mechanism operated by a user in addition to the locating portion described above. For example, a setup is known in which units are connected with each other by an automatically or manually moveable hook.

Although engagement of the locating portions as described above can restrict the upper unit from displacing horizontally relative to the lower unit, it is not possible to restrict the upper unit from displacing vertically relative to the lower unit. In this manner, there is a risk that the locating portions may disengage from each other due to an impact caused by such as an earthquake or a body colliding with the image forming apparatus and the upper unit may accordingly separate from the lower unit. When a connection mechanism configured to be operated by a user is provided, there is a possibility that the user may forget to operate the connection mechanism. Consequently, there is a risk of occurrence of a similar problem since the connection mechanism is not always be used properly by the user.

When the units are connected with each other by the moveable hook, a mechanism configured to operate this hook is required. Consequently, it will be difficult to mount the movable hook in a small image forming apparatus due to spatial restriction. Furthermore, there is a risk of an increase in costs due to an increase in the number of components. In particular, when a mechanism for sliding the unit is required in addition to the moveable hook, serious problems further arise in relation to space and cost.

SUMMARY

In an aspect of the present disclosure, an image forming apparatus includes a plurality of units configured to be connected with each other in a vertical direction, a first fitting portion and a second fitting portion, and a first fitted portion and a second fitted portion. The first fitting portion and second fitting portion are provided at a lower portion of an upper unit that is one unit of the plurality of units. The first fitted portion and second fitted portion are provided at an upper portion of a lower unit that is downwardly adjacent to the upper unit. The first fitted portion is disposed at a position corresponding to the first fitting portion and the second fitted portion is disposed at a position corresponding to the second fitting portion. The upper unit is restricted from displacing in the vertical direction relative to the lower unit when the first fitting portion engages with the first fitted portion. The second fitting portion engages with the second fitted portion such that the upper unit is restricted from moving horizontally relative to the lower unit, when a user causes the upper unit to pivot downwardly about the first fitting portion while the first fitting portion is in engagement with the first fitted portion.

DETAILED DESCRIPTIONS

A setup of a printer as an example of an image forming apparatus according to an embodiment of the present disclosure will be described making reference to FIG. 1 to FIG. 9.

Figure 1:
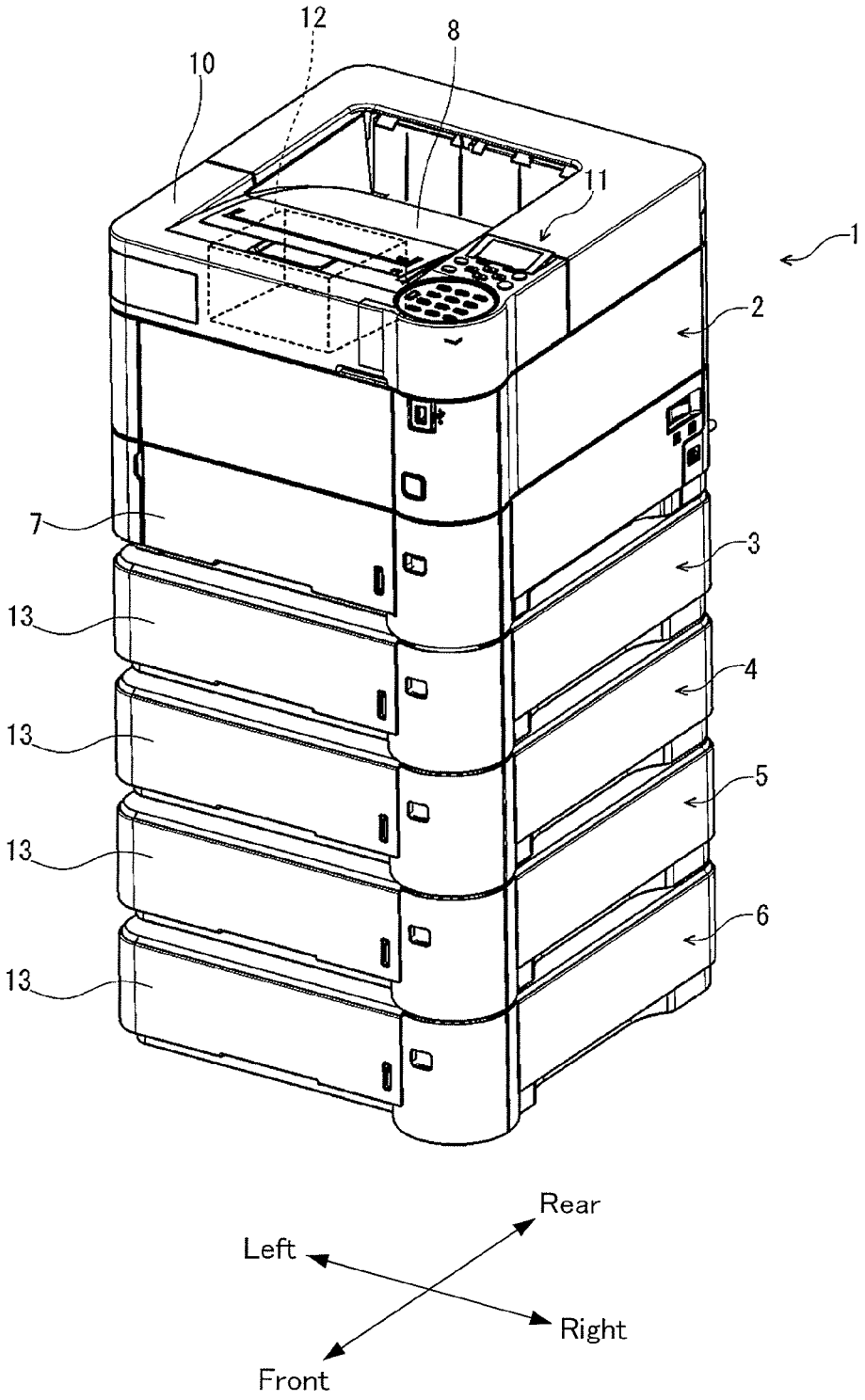
FIG. 1 is a perspective view of an image forming apparatus according to an embodiment of the present disclosure.
Figure 3:
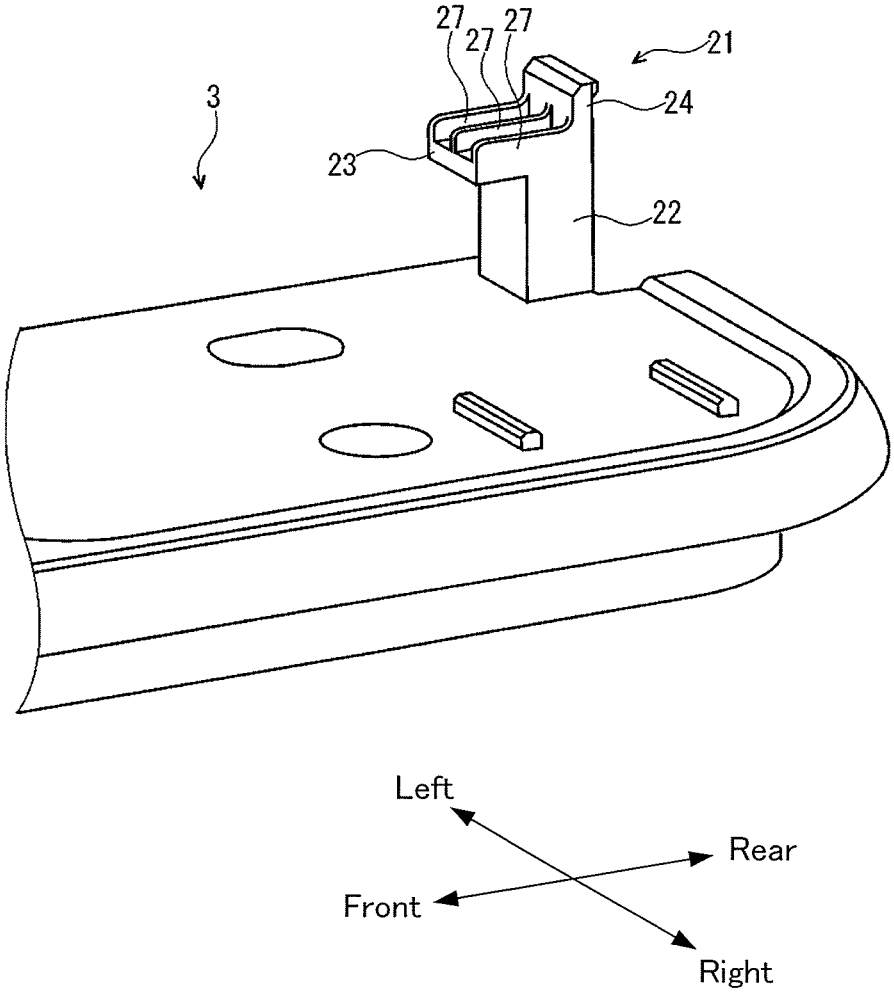
FIG. 3 is a perspective view illustrating a periphery region of a hook in the first sheet feed unit of the image forming apparatus according to the embodiment of the present disclosure.
Figure 4:
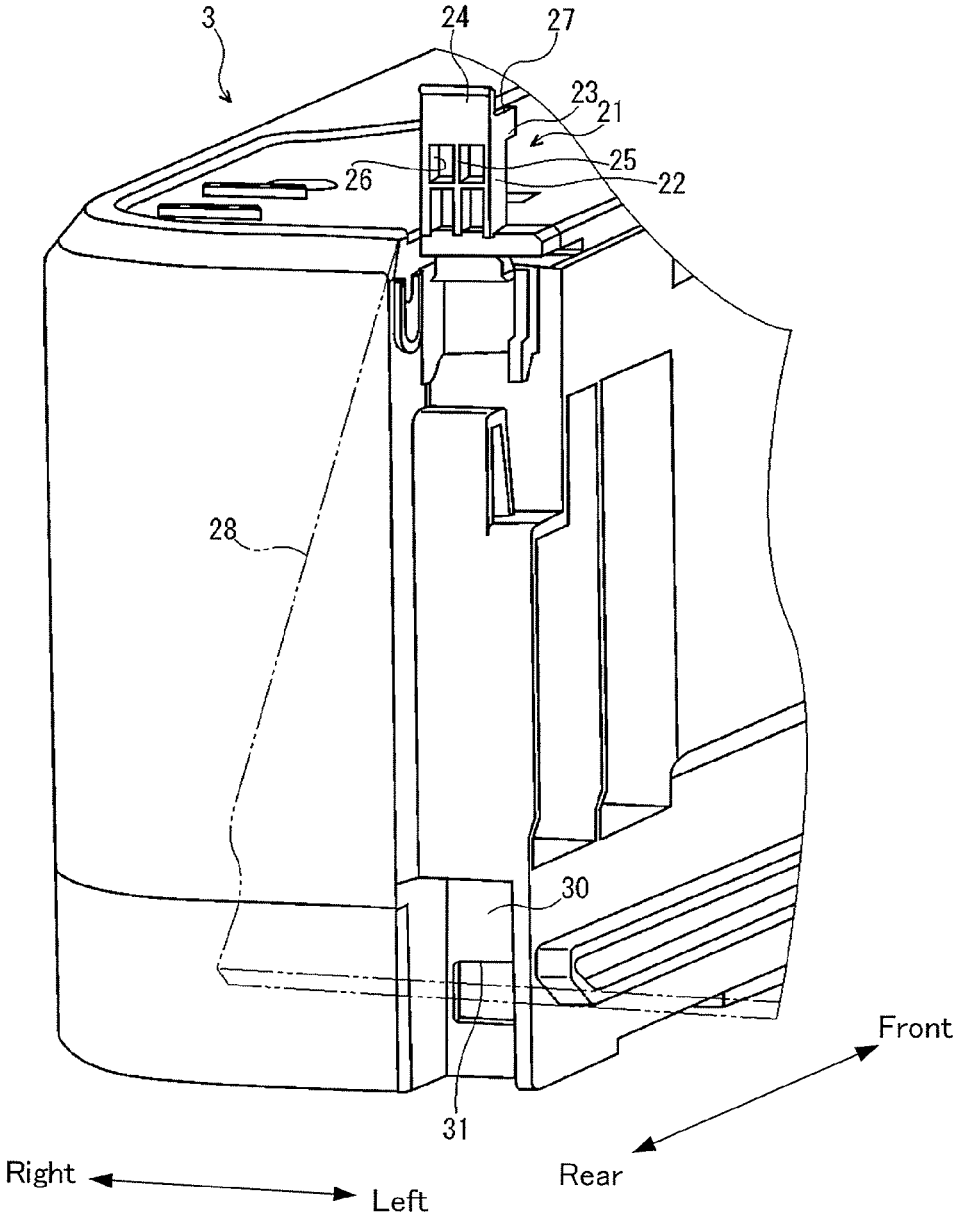
FIG. 4 is a perspective view illustrating the first sheet feed unit of the image forming apparatus according to the embodiment of the present disclosure when a rear surface cover is removed from the first sheet feed unit.

For the sake of convenience of the description, a left and forward side of the face of a page in FIG. 1 is taken to be a front side of the printer. A left side of each sheet of FIG. 2, FIG. 3 and FIG. 5 to FIG. 9 is a front side of the printer. In FIG. 4, a right and inner side of the sheet is a front side of the printer.

As illustrated in FIG. 1, a printer 1 includes a main unit 2 disposed at an upper portion of the printer 1, a first sheet feed unit 3 connected to a lower side of the main unit 2, a second sheet feed unit 4 connected to a lower side of the first sheet feed unit 3, a third sheet feed unit 5 connected to a lower side of the second sheet feed unit 4, and a fourth sheet feed unit 6 connected to a lower side of the third sheet feed unit 5. Hereinafter, the first to four sheet feed units 3 to 6 are collectively referred to as respective sheet feed units 3-6.

The main unit 2 has a substantially rectangular solid shape. A sheet feed tray 7 drawable in a front direction is provided at a lower portion of the main unit 2. A sheet discharge tray 8 is provided at a center on an upper side of the main unit 2. An upper cover 10 configured to be openable and closable is provided at a front side of the sheet discharge tray 8. An operation panel 11 configured to set various functions of the printer 1 is provided at a corner on a front side of the upper cover 10.

An imaging apparatus 12 is accommodated in the main unit 2. A toner image formed by the imaging apparatus 12 is transferred and fixed onto a sheet of paper supplied from the sheet feed tray 7, and then the sheet of paper is discharged to the sheet discharge tray 8. The imaging apparatus 12 is accommodated directly below the upper cover 10. The imaging apparatus 12 is drawable in the front direction when the upper cover 10 is opened.

The respective sheet feed units 3-6 have a substantially rectangular solid shape. The respective sheet feed units 3-6 include respective sheet feed trays 13 configured to be drawable in the front direction. Sheets of papers contained in the sheet feed trays 13 are supplied to the main unit 2. The respective sheet feed units 3-6 have the same size and shape. Accordingly, the first sheet feed unit 3 will be described below, and description of the second to fourth sheet feed units 4 to 6 will be omitted.

Figure 2:
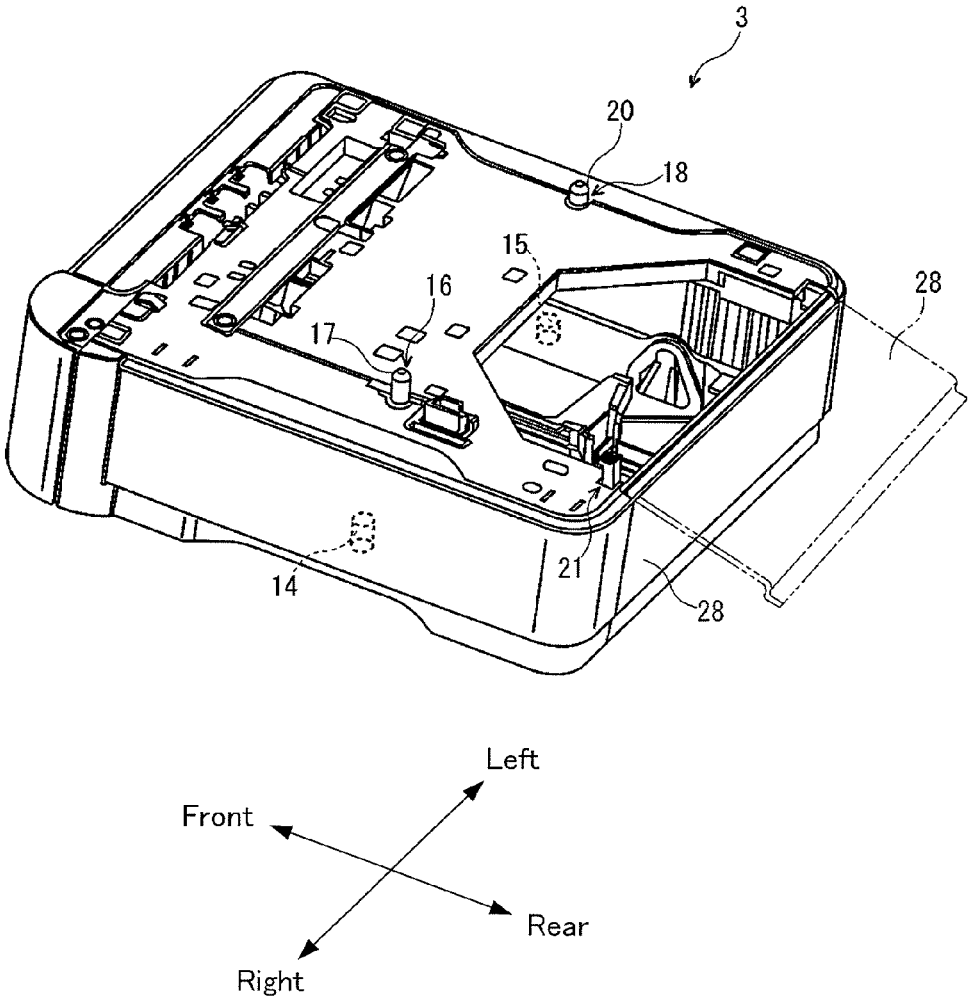
FIG. 2 is a perspective view illustrating a first sheet feed unit in the image forming apparatus according to the embodiment of the present disclosure.

As illustrated in FIG. 2, a cylindrical right fitting hole 14 (second fitting portion) is provided to be oriented in a vertical direction at a center in a front-rear direction on a right side of a lower surface of the first sheet feed unit 3.

A cylindrical left fitting hole 15 (second fitting portion) is provided to be oriented in the vertical direction at a center in the front-rear direction on a left side of the lower surface of the first sheet feed unit 3. A vertical length of the left fitting hole 15 is set to be shorter than that of the right fitting hole 14. A right fitting hole 14 and a left fitting hole 15 are also provided at a bottom surface of the main unit 2.

A cylindrical right boss 16 (second fitted portion) is provided at a center in the front-rear direction on a right side portion of an upper surface of the first sheet feed unit 3. The right boss 16 extends vertically, and an outer diameter of the right boss 16 is set to be smaller than an inner diameter of the right fitting hole 14. A guide portion 17 configured to be tapered upward is provided at an upper portion of the right boss 16.

A cylindrical left boss 18 (second fitted portion) is provided at a center in the front-rear direction on a left side portion of the upper surface of the first sheet feed unit 3. The left boss 18 extends vertically, and an outer diameter of the left boss 18 is set to be smaller than an inner diameter of the left fitting hole 15. A guide portion 20 configured to be tapered upward is provided at an upper portion of the left boss 18. A vertical length of the left boss 18 is set to be shorter than that of the right boss 16.

A hook 21 (first fitted portion) is provided at a rear end and right portion of the upper surface of the first sheet feed unit 3. The hook 21 is provided rearward with respect to the right boss 16. As illustrated in FIG. 3, the hook 21 includes a support pillar 22 configured to extend upwardly from the upper surface of the first sheet feed unit 3, and a projecting portion 23 configured to project towards the front from an upper portion of the support pillar 22. The hook 21 looks substantially like a shape of a letter L when viewed from the side.

An extension 24 configured to extend upwardly further than the projecting portion 23 is provided at a rear upper end of the support pillar 22. As illustrated in FIG. 4, four recessed portions 26 that are partitioned by a cross-shaped reinforcing member 25 are provided at a rear surface side of the support pillar 22.

As illustrated in FIG. 3, the projecting portion 23 extends in a horizontal direction. A total of three ribs 27 are provided at an upper surface of the projecting portion 23 on both right and left ends and transversely at a center therebetween. Each rib 27 is oriented in the front-rear direction and a rear end of each rib 27 extends to a front surface of the extension 24.

As illustrated in FIG. 2, a rear surface (peripheral surface) of the first sheet feed unit 3 is covered by a rear surface cover 28. The rear surface cover 28 is pivotally attached to be openable and closable about a support provided at an upper end portion of the rear surface cover 28.

Figure 5:
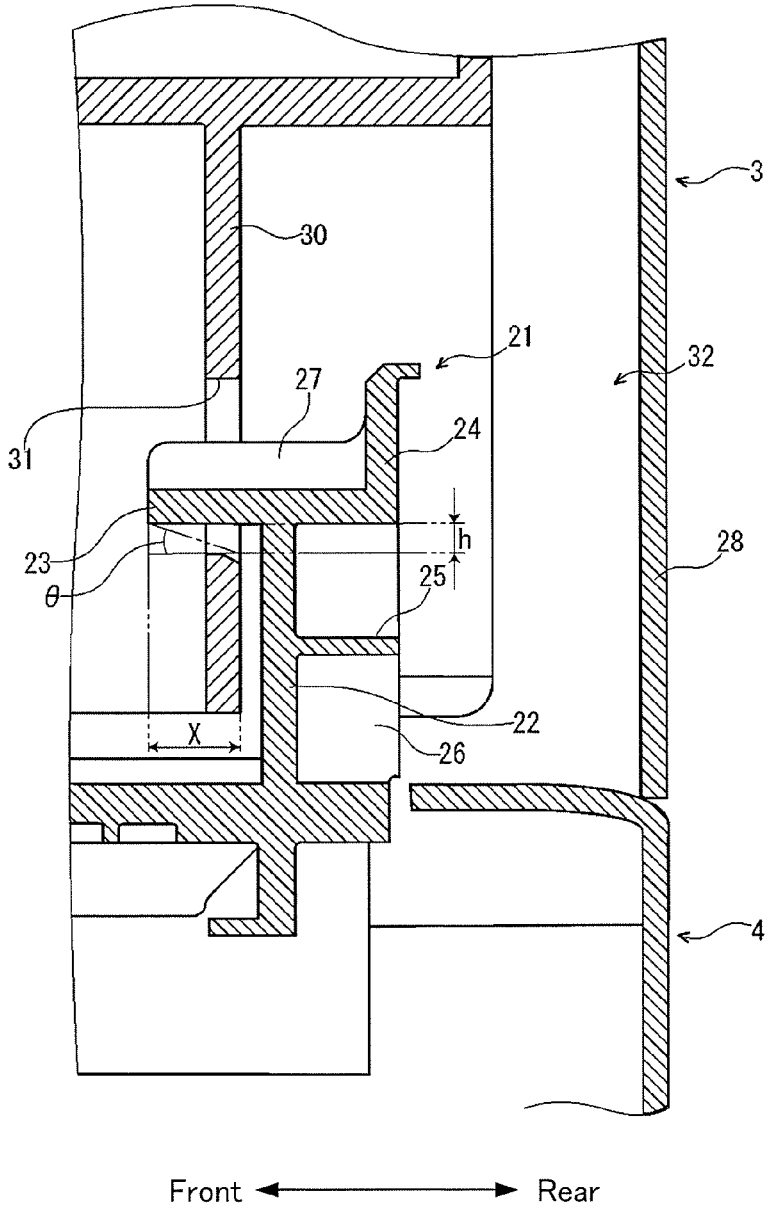
FIG. 5 is a sectional view illustrating an inserting hole of the first sheet feed unit engaged with a hook of a second sheet feed unit in the image forming apparatus according to the embodiment of the present disclosure.

As illustrated in FIG. 4, a connecting plate 30 configured to extend in the vertical direction is provided at a lower end of a right side portion of a rear surface of the first sheet feed unit 3. When viewed from the rear, a substantially rectangular inserting hole 31 (first fitting portion) is drilled in the horizontal direction at the connecting plate 30. As illustrated in FIG. 5, the inserting hole 31 is provided at a position covered by the rear surface cover 28 when the rear cover 28 is closed. A hook accommodating space 32 is formed between the inserting hole 31 and the rear surface cover 28. A vertical length of the inserting hole 31 is set to be longer than that of the projecting portion 23 of the hook 21. An inserting hole 31 the same as what is described above is also provided at a rear surface of the main unit 2.

A method to connect an upper unit to a lower unit in the setup as described above will be described with reference to an example in which the first sheet feed unit 3 is connected with the second sheet feed unit 4.

Figure 6:
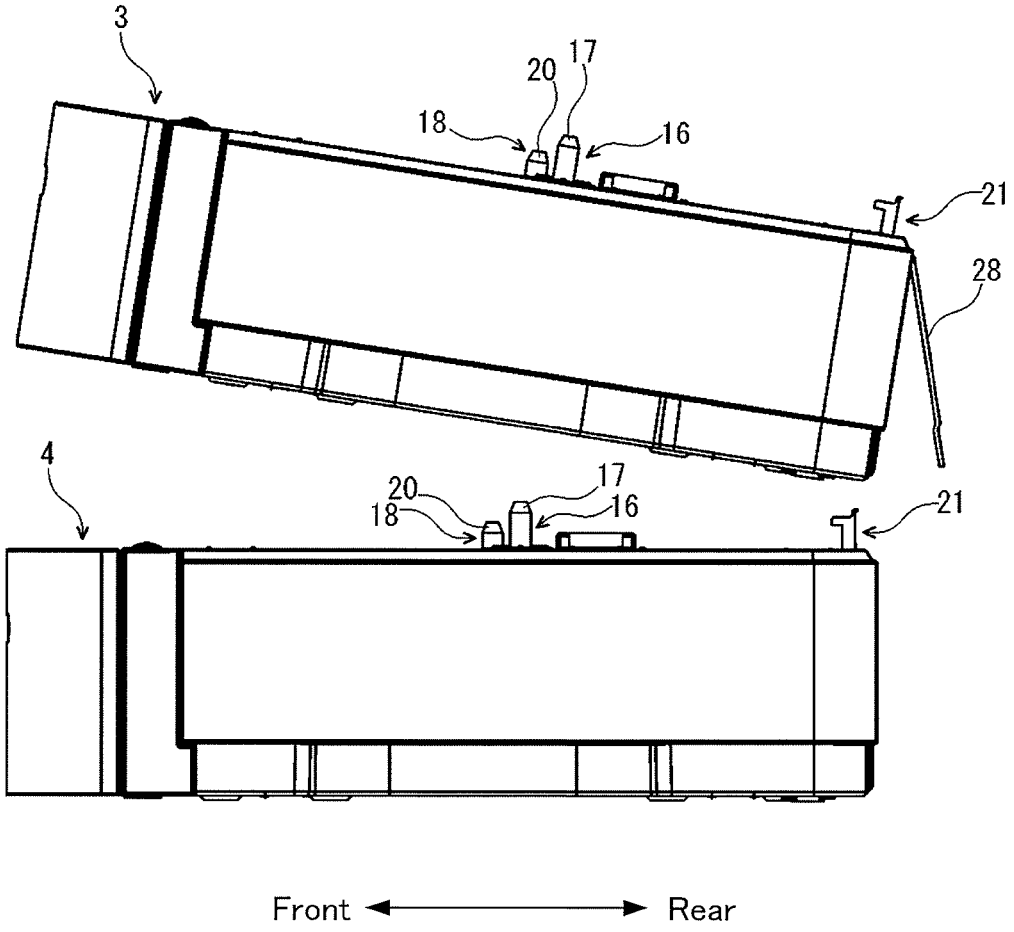
FIG. 6 is a perspective view illustrating the first sheet feed unit that is retained in an inclined position above the second sheet feed unit in the image forming apparatus according to the embodiment of the present disclosure.

Firstly, as illustrated in FIG. 6, a user holds the first sheet feed unit 3 to be downwardly sloped in a rear direction above the second sheet feed unit 4, which is horizontally positioned. In this connection, as illustrated in FIG. 6, the rear surface cover 28 of the first sheet feed unit 3 is maintained opened.

Figure 7:
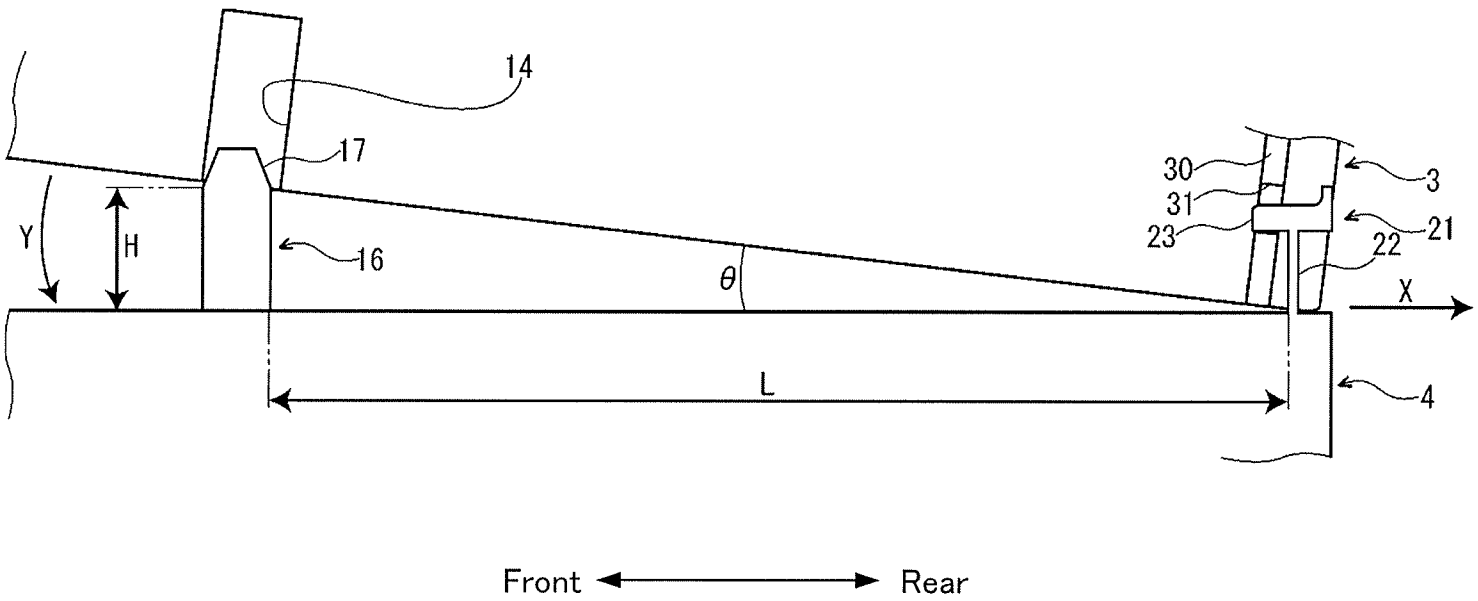
FIG. 7 is a schematic view illustrating the first sheet feed unit that is before being downwardly pivoted in the image forming apparatus according to the embodiment of the present disclosure.

As illustrated in FIG. 7, the user causes the inserting hole 31 of the first sheet feed unit 3 to engage with the hook 21 of the second sheet feed unit 4, and also a rear end portion of the lower surface of the first sheet feed unit 3 to abut with a rear end portion of the upper surface of the second sheet feed unit 4. As a result, the first sheet feed unit 3 is restricted from displacing in the vertical direction relative to the second sheet feed unit 4.

As described above, since the vertical length of the inserting hole 31 in the respective sheet feed units 3-6 is configured to be longer than the vertical length of the projecting portion 23 of the hook 21 of the respective sheet feed units 3-6, a gap is formed between the projecting portion 23 of the hook 21 of the second sheet feed unit 4 and the inserting hole 31 of the first sheet feed unit 3. That is to say, the projecting portion 23 of the hook 21 of the second sheet feed unit 4 is freely inserted into the inserting hole 31 of the first sheet feed unit 3.

Figure 8:
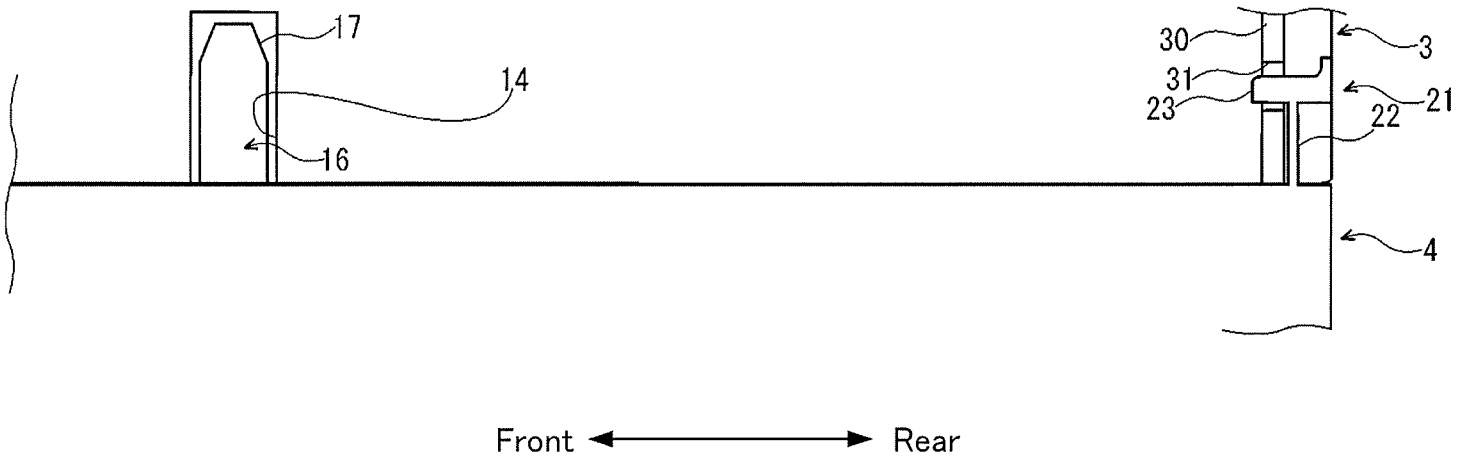
FIG. 8 is a schematic view illustrating the first sheet feed unit that is after being downwardly pivoted in the image forming apparatus according to the embodiment of the present disclosure.

Next, the user causes the first sheet feed unit 3 to downwardly pivot using the inserting hole 31 (the rear end side in the present embodiment) as a supporting point (refer to an arrow Y in FIG. 7), while she or he causes the first sheet feed unit 3 to slide in the rear direction (refer to an arrow X in FIG. 7). In this manner, as illustrated in FIG. 8, the right fitting hole 14 of the first sheet feed unit 3 is fitted with the right boss 16 of the second sheet feed unit 4. Although not illustrated, the left fitting hole 15 of the first sheet feed unit 3 is simultaneously fitted with the left boss 18 of the second sheet feed unit 4. As a result, the first sheet feed unit 3 is restricted from displacing in the horizontal direction relative to the second sheet feed unit 4.

As described above, since the outer diameter of the right boss 16 in the respective sheet feed units 3-6 is smaller than the inner diameter of the right fitting hole 14 of the respective sheet feed units 3-6, a gap is formed between the right boss 16 of the second sheet feed unit 4 and the right fitting hole 14 of the first sheet feed unit 3. That is to say, the right boss 16 of the second sheet feed unit 4 is freely fitted into the right fitting hole 14 of the first sheet feed unit 3.

In a similar manner, the left boss 18 of the second sheet feed unit 4 is freely fitted into the left fitting hole 15 of the first sheet feed unit 3.

When the user closes the rear surface cover 28 of the first sheet feed unit 3 after the operation described above, the connection operation of the first sheet feed unit 3 with respect to the second sheet feed unit 4 is completed. In this manner, when the rear surface cover 28 of the first sheet feed unit 3 is closed, as illustrated in FIG. 5, the hook 21 of the second sheet feed unit 4 is accommodated in the hook accommodating space 32 of the first sheet feed unit 3. A part where the hook 21 of the second sheet feed unit 4 engages with the inserting hole 31 of the first sheet feed unit 3 is covered by the rear surface cover 28 of the first sheet feed unit 3.

It should be noted that a method of connecting the main unit 2 to the first sheet feed unit 3, a method of connecting the second sheet feed unit 4 to the third sheet feed unit 5, and a method of connecting the third sheet feed unit 5 to the fourth sheet feed unit 6 are the same as the method described above.

In the present embodiment, it is possible to restrict the first sheet feed unit 3 from displacing horizontally and vertically relative to the second sheet feed unit 4 as described above. Since it is possible to restrict the first sheet feed unit 3 from separating from the second sheet feed unit 4, it is possible to increase the safety of the apparatus. In addition, since the hook 21 of a fixed type integrated with the second sheet feed unit 4 is used instead of a moveable hook, it will not be necessary to add a component to drive the moveable hook. As a result, it is possible to implement space saving and cost reduction. Furthermore, the operation of connecting the first sheet feed unit 3 with the second sheet feed unit 4 is necessarily followed by the engagement of the inserting hole 31 of the first sheet feed unit 3 with the hook 21 of the second sheet feed unit 4. Accordingly, it is possible to prevent the apparatus from being used without the inserting hole 31 of the first sheet feed unit 3 being engaged with the hook 21 of the second sheet feed unit 4.

In the present embodiment, the inserting hole 31 provided at the rear surface of the first sheet feed unit 3 is engaged with the hook 21 provided at a rear end portion of the second sheet feed unit 4. As a result, there is no risk that a rear side of the first sheet feed unit 3 is lifted and the first sheet feed unit 3 forwardly slopes, for example, even if the center of gravity of the main unit 2 moves forward when the imaging apparatus 12 is drawn toward the front. Similarly, there is no risk that the main unit 2, the second sheet feed unit 4 and the third sheet feed unit 5 forwardly slope. Consequently, it is possible to further increase the safety of the apparatus.

Furthermore, the right boss 16 of the second sheet feed unit 4 is freely fitted into the right fitting hole 14 of the first sheet feed unit 3, and the left boss 18 of the second sheet feed unit 4 is freely fitted into the left fitting hole 15 of the first sheet feed unit 3. Accordingly, when the first sheet feed unit 3 is pivoted downwardly, and the fitting holes 14 and 15 of the first sheet feed unit 3 are fitted with the bosses 16 and 18 of the second sheet feed unit 4, an inner peripheral surface of each of the fitting holes 14 and 15 of the first sheet feed unit 3 is suppressed from coming into contact with an outer peripheral surface of each of the bosses 16 and 18 of the second sheet feed unit 4. As a result, it is possible to smoothly pivot the first sheet feed unit 3.

Furthermore, since the projecting portion 23 of the hook 21 of the second sheet feed unit 4 is configured to be freely inserted into the inserting hole 31 of the first sheet feed unit 3, it is possible to facilitate the insertion of the projecting portion 23 of the hook 21 of the second sheet feed unit 4 into the inserting hole 31 of the first sheet feed unit 3. Furthermore, it is possible to suppress trouble that the projecting portion 23 of the hook 21 of the second sheet feed unit 4 comes into contact with and is deformed by the inserting hole 31 of the first sheet feed unit 3, when the first sheet feed unit 3 is downwardly pivoted, for example.

The hook 21 of the second sheet feed unit 4 is accommodated in the hook accommodating space 32 formed between the inserting hole 31 and the rear surface cover 28 of the first sheet feed unit 3. Since the part where the hook 21 of the second sheet feed unit 4 engages with the inserting hole 31 of the first sheet feed unit 3 is difficult to see from the outside, it is possible to improve the external appearance of the apparatus.

In the present embodiment, the first sheet feed unit 3 is configured to slide in the rear direction when the first sheet feed unit 3 is downwardly pivoted. Accordingly, the supporting point for pivoting gradually displaces towards the rear when the first sheet feed unit 3 is pivoted. In this manner, the respective fitting holes 14 and 15 of the first sheet feed unit 3 displace from upper to lower side in a substantially vertical trajectory. As a result, it is possible to cause the fitting holes 14 and 15 of the first sheet feed unit 3 to be easily fit with the bosses 16 and 18 of the second sheet feed unit 4, respectively.

Furthermore, when the first sheet feed unit 3 is removed from the second sheet feed unit 4, it is possible to easily disengage the hook 21 of the second sheet feed unit 4 from the inserting hole 31 of the first sheet feed unit 3 according to a procedure opposite to that for connection without a special operation.

Furthermore, the guide portion 17 is provided at an upper end of the right boss 16 of the second sheet feed unit 4, and the guide portion 20 is provided at an upper end of the left boss 18 of the second sheet feed unit 4. Accordingly, it is possible to easily align the bosses 16 and 18 of the second sheet supply unit 4 with the fitting holes 14 and 15 of the first sheet feed unit 3, respectively.

The relationship between a dimension of each portion and an inclination angle of an upper unit relative to a lower unit in the printer 1 according to the present embodiment will be described with reference to an example using the first sheet feed unit 3 and the second sheet feed unit 4.

Figure 9:
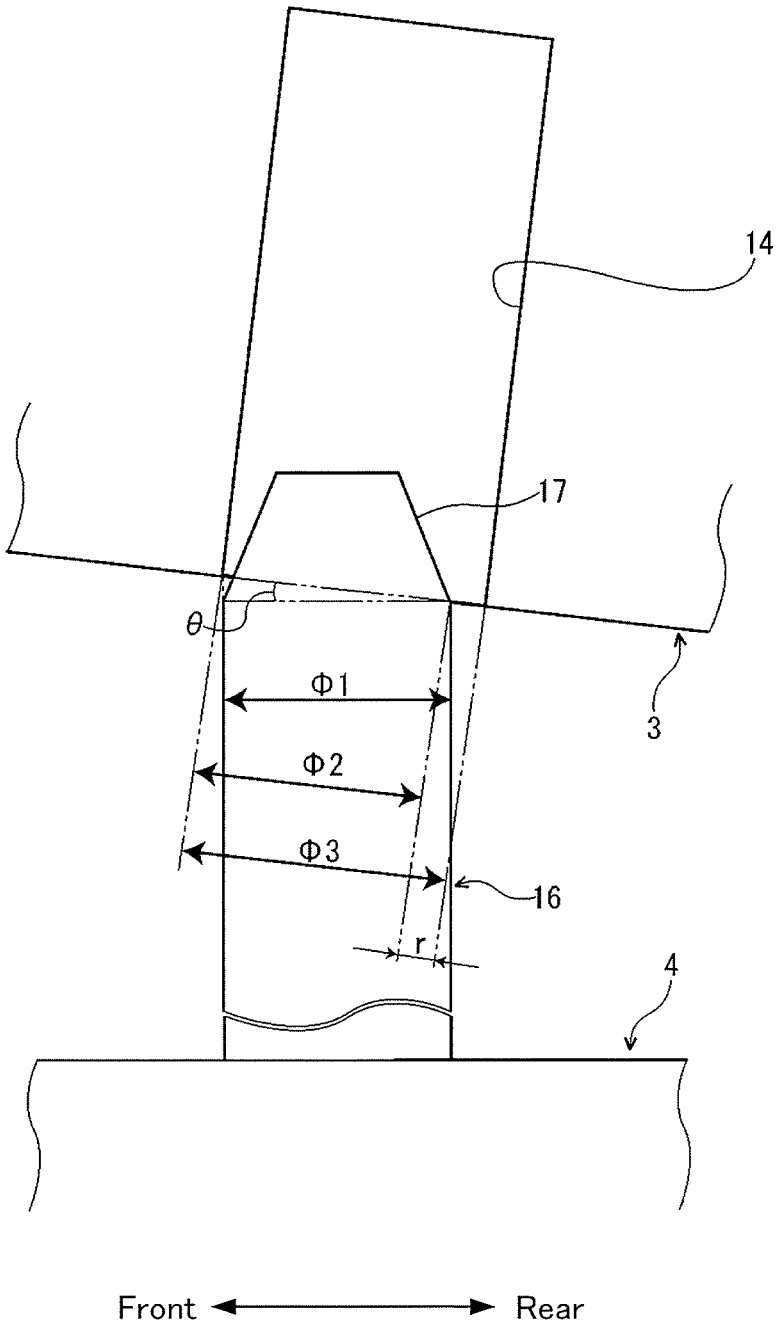
FIG. 9 is a partial enlarged view of FIG. 7.

As illustrated in FIG. 9, an outer diameter of the right boss 16 of the second sheet feed unit 4 is denoted as 01, an inner diameter of the right fitting hole 14 of the first sheet feed unit 3 required for insertion of the right boss 16 is denoted as $\Phi 2$, and a maximum inclination angle (maximum value of the inclination angle) of the first sheet feed unit 3 to the second sheet feed unit 4 is denoted as $\theta$.

Since $\cos\theta=(\Phi 1/\Phi 2)$, the maximum inclination angle $\theta$ may be calculated as:

$$\theta=\cos^{-1}(\Phi 1/\Phi 2).$$

For example, when $\Phi 1$ is 9.9 mm and $\Phi 2$ is 10. 03 mm, $$\theta=\cos^{-1}(9.9/10.3)=9.23 \text{ [degrees]}.$$

It should be noted that an actual inner diameter of the right fitting hole 14 of the first sheet feed unit 3 is set to a dimension $\Phi 3$ calculated by addition of a margin "r" to $\Phi 2$, for example.

As illustrated in FIG. 7, when a distance from the hook 21 of the second sheet feed unit 4 to the right boss 16 is denoted as L, a height H of the right boss 16 (height of the portion excluding the guide portion 17 of the right boss 16) is given as:

$$H=L\tan\theta.$$

For example, when L=100 mm and θ=9.23°, $$H=100\tan(9.23)=16.25\ [\text{mm}].$$

This value expresses the maximum height of the right boss 16 of the second sheet supply unit 4 that allows the right fitting hole 14 of the first sheet feed unit 3 to fit with the right boss 16 of the second sheet feed unit 4, when the first sheet feed unit 3 slopes at the maximum inclination angle θ. That is to say, it is required that the height H of the right boss 16 of the second sheet feed unit 4 be adjusted to no more than 16.25 mm.

As illustrated in FIG. 5, a gap "h" is formed between the inserting hole 31 of the first sheet feed unit 3 and the projecting portion 23 of the hook 21 of the second sheet feed unit 4, when the inserting hole 31 of the first sheet feed unit 3 engages with the hook 21 of the second sheet feed unit 4.

When an engagement length of the inserting hole 31 of the first sheet feed unit 3 and the projecting portion 23 of the hook 21 of the second sheet feed unit 4 is denoted as X, $$\text{since } X\tan\theta=h,$$

$$\text{then } X=h/\tan\theta.$$

For example, when h=1 mm, and θ=9.23°, $$X=1/\tan(9.23°=6.15\ [\text{mm}].$$

In this embodiment, descriptions have been provided for a case where the fitting holes 14 and 15 are provided at an upper unit and the bosses 16 and 18 are provided at a lower unit. However, it may be alternatively possible in another embodiment that the bosses 16 and 18 are provided at the upper unit and the inserting holes 14 and 15 are provided at the lower unit opposite to the embodiment described above.

In the present embodiment, descriptions have been provided for a case where the inserting hole 31 is provided at the upper unit, and the hook 21 is provided at the lower unit. However, it may be alternatively possible in another embodiment that the hook 21 is provided at the upper unit and the inserting hole 31 is provided at the lower unit opposite to the embodiment described above.

The present embodiment has been described for a case where the setup of the present disclosure is applied to a printer. However, it may be alternatively possible in a different embodiment that the setup of the present disclosure is applied to another image forming apparatus such as a copying machine, facsimile machine, multifunctional device, or the like.

The invention claimed is:

1. An image forming apparatus comprising:

a plurality of units configured to be connected with each other in a vertical direction;

a first fitting portion and a second fitting portion provided at a lower portion of an upper unit that is one unit of the plurality of units; and a first fitted portion and a second fitted portion provided at an upper portion of a lower unit that is downwardly adjacent to the upper unit, wherein the first fitted portion is disposed at a position corresponding to the first fitting portion and the second fitted portion is disposed at a position corresponding to the second fitting portion, wherein the upper unit is restricted from displacing in the vertical direction relative to the lower unit when the first fitting portion engages with the first fitted portion, wherein the second fitting portion engages with the second fitted portion such that the upper unit is restricted from moving horizontally relative to the lower unit, when a user causes the upper unit to pivot downwardly about the first fitting portion while the first fitting portion is in engagement with the first fitted portion, wherein the first fitting portion comprises an inserting hole oriented in a horizontal direction, the inserting hole being located at a peripheral surface of the upper unit, wherein the first fitted portion comprises a hook having a projecting portion configured to extend in the horizontal direction and to be freely inserted into the inserting hole, the hook being located at an upper surface of the lower unit and accommodated in a space formed between a cover configured to cover the peripheral surface of the upper unit and the inserting hole, wherein the cover is configured to be pivotable about an upper edge of the cover such that the cover is openable and closeable and to open when the projecting portion of the hook is inserted into the inserting hold, and wherein the inserting hole is located at a position covered by the cover when the cover is closed.

2. The image forming apparatus according to claim 1, wherein the second fitting portion comprises a pair of fitting holes oriented in the vertical direction, and the second fitted portion comprises a pair of bosses configured to extend in the vertical direction and fit freely with the pair of fitting holes, and wherein a vertical length of one of the pair of bosses is configured to be shorter than a vertical length of the other thereof.

3. An image forming apparatus comprising a plurality of units configured to be connected with each other in a vertical direction;

a first fitting portion and a second fitting portion provided at a lower portion of an upper unit that is one unit of the plurality of units; and a first fitted portion and a second fitted portion provided at an upper portion of a lower unit that is downwardly adjacent to the upper unit, wherein the first fitted portion is disposed at a position corresponding to the first fitting portion and the second fitted portion is disposed at a position corresponding to the second fitting portion, wherein the upper unit is restricted from displacing in the vertical direction relative to the lower unit when the first fitting portion engages with the first fitted portion, wherein the second fitting portion engages with the second fitted portion such that the upper unit is restricted from moving horizontally relative to the lower unit, when a user causes the upper unit to pivot downwardly about the first fitting portion while the first fitting portion is in engagement with the first fitted portion, wherein the second fitting portion comprises a pair of a fitting holes oriented in the vertical direction, and the second fitted portion comprises a pair of bosses configured to extend in the vertical direction and fit freely with the pair of fitting holes, and wherein a vertical length of one of the pair of bosses is configured to be shorter than a vertical length of the other thereof.

4. The image forming apparatus according to claim 3, wherein one of the first fitting portion and the first fitted portion comprises an inserting hole oriented in a horizontal direction, and the other of the first fitting portion and the first fitted portion comprises a hook having a projecting portion configured to extend in the horizontal direction and to be freely inserted into the inserting hole.

5. The image forming apparatus according to claim 4, wherein the inserting hole is located at a peripheral surface of the upper unit, and wherein the hook is located at an upper surface of the lower unit and accommodated in a space formed between a cover configured to cover the peripheral surface of the upper unit and the inserting hole.

* * * * *